US012735158B2

(12) United States Patent
Sentlinger

(10) Patent No.: US 12,735,158 B2
(45) Date of Patent: Sep. 15, 2026

(54) WATERWAY SENSOR

(71) Applicant: Gabriel Sentlinger, Bowen Island (CA)

(72) Inventor: Gabriel Sentlinger, Bowen Island (CA)

( * ) Notice: Subject to any disclaimer, the term of this patent is extended or adjusted under 35 U.S.C. 154(b) by 668 days.

(21) Appl. No.: 18/139,921

(22) Filed: Apr. 26, 2023

(65) Prior Publication Data

US 2024/0076022 A1 Mar. 7, 2024

Related U.S. Application Data

(60) Provisional application No. 63/336,713, filed on Apr. 29, 2022.

(51) Int. Cl.

| | |
|---|---|
| ***B63G 8/38*** | (2006.01) |
| ***B63B 21/50*** | (2006.01) |
| ***B63B 22/00*** | (2006.01) |
| ***B63B 22/18*** | (2006.01) |
| ***B63G 8/22*** | (2006.01) |
| ***B63G 8/24*** | (2006.01) |

(52) U.S. Cl.

CPC ..... *B63G 8/38* (2013.01); *B63B 21/50* (2013.01); *B63B 22/00* (2013.01); *B63B 22/18* (2013.01); *B63G 8/22* (2013.01); *B63G 8/24* (2013.01)

(58) Field of Classification Search

CPC ... B63G 8/00; B63G 8/22; B63G 8/24; B63G 8/38; B63B 21/00; B63B 21/16; B63B 21/50; B63B 22/00; B63B 22/04; B63B 22/06; B63B 22/18; B63B 22/20

USPC ..... 114/330; 441/21, 22, 23, 24, 25, 26, 27, 441/28, 29

See application file for complete search history.

(56) References Cited

U.S. PATENT DOCUMENTS

| | | | | |
|---|---|---|---|---|
| 3,962,046 | A | 6/1976 | Morrison | |
| 4,593,561 | A | 6/1986 | Gavrilovic | |
| 4,745,801 | A | 5/1988 | Luzier | |
| 6,429,778 | B1 | 8/2002 | Chuang | |
| 6,958,693 | B2 | 10/2005 | Rothgeb et al. | |
| 7,062,962 | B2 | 6/2006 | Pasternack et al. | |
| 10,472,032 | B2 | 11/2019 | Peterson et al. | |
| 11,952,082 | B2 * | 4/2024 | Cappellini | B63G 8/24 |
| 2020/0267916 | A1 | 8/2020 | Sol | |

(Continued)

FOREIGN PATENT DOCUMENTS

| | | | |
|---|---|---|---|
| CN | 105651345 | A | 6/2016 |
| CN | 109883499 | B | 6/2019 |
| CN | 216082725 | U | 3/2022 |

(Continued)

OTHER PUBLICATIONS

Hensley R et al; A comparison of water quality sensor deployment designs in wadeable streams; Limnol. Oceanogr.: Methods 19, 2021, pp. 673-681.

(Continued)

*Primary Examiner* — Lars A Olson
(74) *Attorney, Agent, or Firm* — Nathan V. Woodruff

(57) ABSTRACT

A waterway sensor includes a housing having a sidewall with a plurality of openings, and at least one sensor element disposed within the housing. The at least one sensor element senses one or more properties of a waterway. A flexible elongate support is connected between the housing and a bank of the waterway. At least one of the housing and the elongate support is designed to bias the housing toward a desired position within the waterway.

23 Claims, 2 Drawing Sheets

(56) References Cited

U.S. PATENT DOCUMENTS

2021/0215518 A1 7/2021 Rufo et al.

FOREIGN PATENT DOCUMENTS

| | | | |
|---|---|---|---|
| FR | 3105402 | A1 | 6/2021 |
| JP | S61283823 | A | 12/1986 |
| JP | H04248463 | A | 9/1992 |
| JP | H06254533 | A | 9/1994 |
| JP | 2000065647 | A | 3/2000 |
| JP | 2002202163 | A | 7/2002 |
| JP | 2015210228 | A | 11/2015 |

OTHER PUBLICATIONS

Sentlinger G et al; Salt Dilution Flow Measurement: Automation and Uncertainty; HydroSenSoft, International Symposium and Exhibition on Hydro-Environment Sensors and Software; Feb. 26-Mar. 1, 2019, Madrid, Spain.

* cited by examiner

WATERWAY SENSOR

TECHNICAL FIELD

This relates to sensors for measuring the flow of water in waterways, in particular sensors that measure properties of the flow of water.

BACKGROUND

Sensors submerged in waterways may be used to measure various properties of the water. An example of a waterway sensor is described in U.S. Pat. No. 4,854,166 (Futrell) entitled "Lightweight wading rod for stream flow measurements".

SUMMARY

According to an aspect, there is provided a waterway sensor, comprising a housing having a sidewall that comprises a plurality of openings, and at least one sensor element disposed within the housing. The at least one sensor element senses one or more properties of a waterway. An elongate support connects between the housing and a bank of the waterway, the elongate support being flexible. At least one of the housing and the elongate support is designed to bias the housing toward a desired position within the waterway.

According to other aspects, the waterway sensor may comprise one or more of the following features, alone or in combination: the housing may comprise a one-way valve at a downstream end of the housing; the elongate support may comprise an air-filled conduit; the elongate support may be a resilient conduit; the elongate support, the housing, or both the elongate support and the housing may comprise buoyant material; the sidewall may comprise a wedge wire screen; there may be an expandable bladder or a ballast tank; there may be at least one depth sensor, the depth sensor being used by a controller to control a buoyancy of the waterway sensor by adjusting a volume of the expandable bladder or an amount of ballast in the ballast tank; the at least one sensor element may sense a mineral concentration in water flowing in the waterway; and the at least one sensor element may senses a concentration of salt in the water.

According to an aspect, there is provided a method of sensing properties of a waterway comprising the steps of: connecting a waterway sensor as described above to a bank of the waterway; positioning the housing at a desired location within the waterway, wherein at least one of the housing and the elongate support are designed to bias the housing toward the desired position; and using the at least one sensor element, sensing at least one property of the waterway, which may be a mineral concentration, such as a salt concentration, in the water.

According to another aspect, the method may further comprise the steps of: sensing a depth of the housing using the depth sensor; and adjusting a volume of the expandable bladder or an amount of ballast in the ballast tank to control a buoyancy of the waterway sensor According to another aspect, the method may further comprise the steps of: connecting one or more additional waterway sensors to the bank of the waterway; positioning the housing at a desired location within the waterway; and using the at least one sensor element of the one or more additional waterway sensors, sensing at least one property of the waterway. The desired locations of the waterway sensor and the one or more additional waterway sensors may be in a plane that is perpendicular to a flow direction of the waterway.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
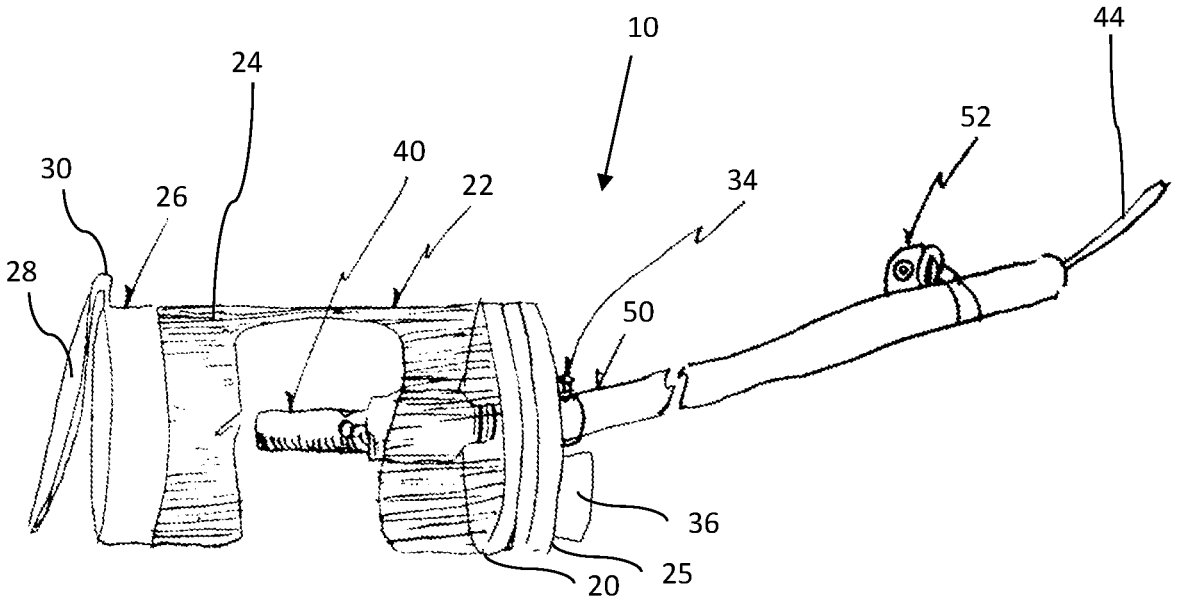
FIG. 1 is a side elevation view of a waterway sensor with the housing partially cut away.

A waterway sensor, generally identified by reference numeral 10, will now be described with reference to FIG. 1 through 3. Waterway sensor 10 is designed to be used to measure one or more properties of a flow of water through a waterway 100. Waterway 100 may be a natural, manmade, and/or controlled body of water that has a current. Waterways 100 in which waterway sensor 10 is used may have objects other than water flowing with the current. This may include a moving bedload or debris that flows with the current. In one example, waterway sensor 10 may be used as a component of tracer dilution measurements of flow in waterway 100.

Referring to FIG. 1, waterway sensor 10 has a housing 20 with a sidewall 22 that is water permeable. As shown, sidewall 22 is a screen 24, such as a wedge wire screen, that defines a plurality of openings that reduces the amount of debris that enters housing 20 while still being water permeable and permitting water to flow therethrough. Sidewall 22 may be cylindrical in shape and made from a wedge wire screen. Screen 24 may be a 2" to 6" round wedge-wire perforated pipe with a 1 mm nominal spacing between wires that allows only liquid to pass into the inner chamber. Screen 24 may be made from stainless steel or other non-corroding metal. Housing 20 may have a first (or upstream) end 25 that is closed and a second (or downstream) end 26. At second end 26, housing 20 may have a one-way valve 28 that opens only in a direction away from housing 20. One-valve may be attached to housing 20 by a top hinge 30. One-way valve 28 may be biased towards a closed position, such as by gravity, a spring hinge, etc. As valve 28 is at the downstream end of housing 20, the flow of water acts to open valve 28 to allow a free flow through housing 20 past the sensor element 40 and such that any debris is flushed from within housing 20. A change in current within the waterway may allow valve 28 to close and prevent debris from backflushing into housing 20.

At least one sensor element 40 is disposed within housing 20. Sensor element 40 may be selected to sense one or more desired properties of waterway 100. For example, sensor element 40 may sense the presence and/or concentration of salt or other components. Waterway sensor 10 may have more than one sensor elements 40 disposed within housing 20 that each measure a different property. For a waterway sensor 10 that is to be used as part of tracer dilution measurements, sensor element may sense a mineral concentration, such as a salt concentration, at a chosen location within waterway 100. Sensor element(s) 40 may also be selected measure pressure, pH, dissolved oxygen, fluorescence, and/or other chemical or physical characteristics.

Figure 2:
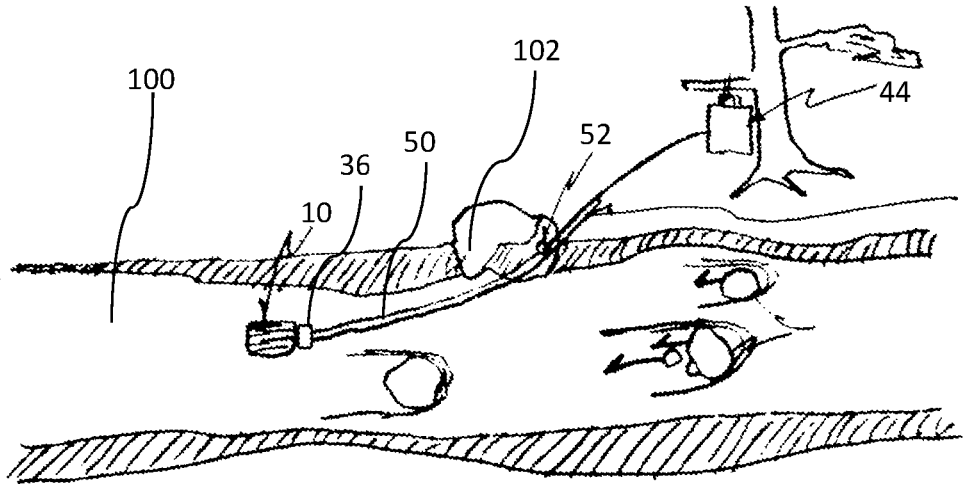
FIG. 2 is a perspective view of a waterway with a waterway sensor.

Referring to FIG. 2, waterway sensor 10 includes an elongate support 50 that extends between housing 20 and a bank 102 of waterway 100. The upstream end of elongate support 50 is anchored relative to bank 102, such as by connecting it to a mount 52 or to an intermediate support 104. In another example, elongate support 50 may be connected to a structure that spans waterway 100, such as a pole or cable. As depicted, the downstream end of elongate support 50 is attached to housing 20 at first end 25 of housing 20. Elongate support 50 may be attached to housing 20 in a manner that orients housing 20 in a particular direction, with first end 25 of housing 20 facing upstream. Elongate support 50 may be a hollow, air-filled conduit and may house a communication line 42 that connects between sensor element 40 and a datalogger 44 or other suitable type of computer processor on bank 102.

Housing 20 may be biased toward a desired position or zone within waterway 100. Waterway sensor 10 is designed such that housing 20 may be permitted to deflect away from the desired position, such as by changes in the flow of water or by being contacted by an object that is carried by the flow of water, and then return toward the desired detection zone. The desired zone may be a fixed location relative to bank 102 or it may change based on the conditions of waterway 100.

Elongate support 50 may help bias housing 20 toward the desired zone. For example, elongate support 50 may be made from a resilient material that is capable of flexing to deflect housing 20 away from the desired position, but is resilient such that it provides the biasing force to return housing to the desired position. Elongate support 50 may be mounted to reduce the strain on sensor housing 20 by being affixed at a single point on the bank and allowing elongate support 50 and housing 20 to be drawn downstream into the direction of flow.

The desired position may also be achieved by appropriate design of the buoyancy of sensor 10. For example, elongate support 50 may be air filled and/or made from a material with a desired buoyancy. Buoyant and/or weighted material, such as a foam piece 36 or other type of buoyant device, may be carried at desired locations along elongate support 50 or housing 20. Buoyant device 36 may be positioned close to waterway sensor 10, as shown in FIG. 2, and may either be mounted to housing 20 or elongate support 50.

Waterway sensor 10 may also have a buoyancy control element (not shown) to control the buoyancy, such as an expandable bladder that can be filled with air, or a ballast tank that can be filled with water. The buoyancy of waterway sensor 10 may be changed by the buoyancy control apparatus to control the position within waterway 100, or to contribute to the biasing force. The buoyancy control element may be capable of dynamically altering the buoyancy of waterway sensor 10 through the use of a controller, which may be incorporated into the datalogger or may be a separate processor, that may adjust a volume of an expandable bladder or an amount of ballast in a ballast tank. The controller may control the buoyancy automatically in response to specific conditions, such as readings from a depth sensor.

A method of sensing properties of waterway 100 using waterway sensor 10 will now be described.

First, a waterway sensor 10 as described above is connected to bank 102 of waterway 100. Waterway sensor 10 is then positioned at a desired location, as discussed above, within waterway 100, and at least one property of waterway 100 is sensed by sensor element 40. The method may include adjusting the buoyancy of waterway sensor 10 based on measurements of depth sensor, such as by adjusting a volume of expandable bladder or an amount of ballast in ballast tank.

Figure 3:
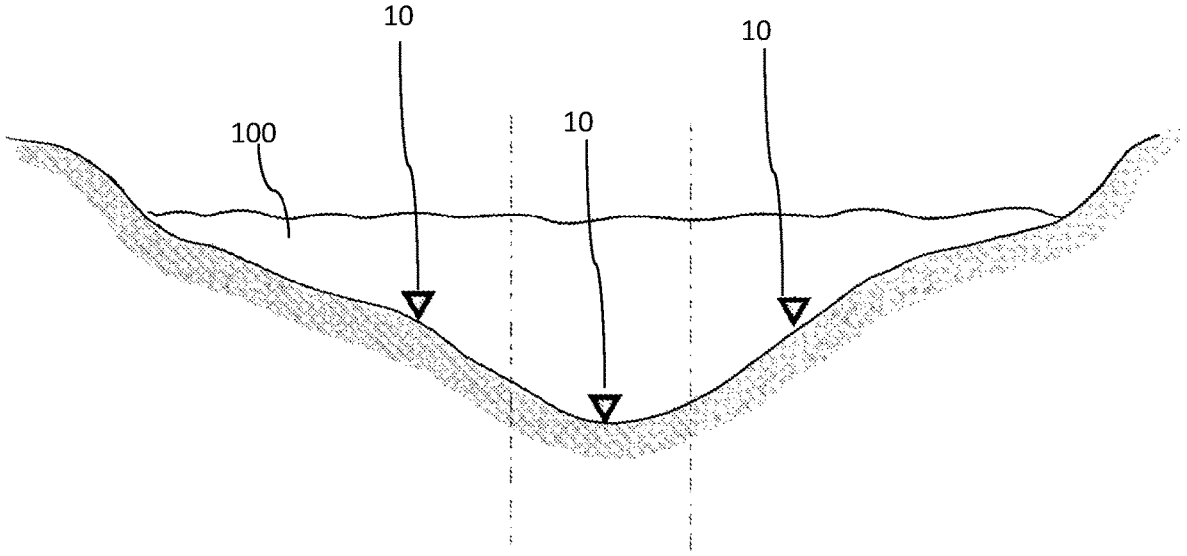
FIG. 3 is a side elevation view in section of a waterway with an array of waterway sensors.

Referring to FIG. 3, the method may include connecting one or more additional waterway sensors 10 to bank 102 and positioning the additional waterway sensors at various predetermined desired locations. In one example, waterway sensors 10 may be positioned such that they are all located in a plane that is perpendicular to a flow direction of waterway 100.

The method may be part of a tracer dilution method, in which waterway sensors 10 measure concentrations of a mineral, such as salt, in waterway 100 after the mineral is introduced in known quantities upstream of waterway sensors 10. In one example that is discussed below, the design is used to protect sensors within a natural waterway, allowing them to sample water quality away from the stream bank, while allowing continuous water flow over the sensor. The sensor housing may be self-flushing and allow for a relatively easy and fast install.

Conventionally, sensors are mounted along the river/stream bank, or within channel 100 if flows are small enough not to damage the installation. For more active channels, sensors are housed within pipes and tubes, or wrapped in wire to become a cabled installation. One example of sensor 10 as depicted in FIGS. 1 and 2 uses a flow through screen 22, has a one-way valve 28 on the outlet of housing 20 to promote self-flushing of sediment and detritus. A threaded inlet fitting 34 at first end 25 attaches housing 20 to a rugged wire conduit 50 to bind housing 20 between the channel and the bank, as shown in FIG. 2.

Sensor 10 may have the following features:

a. The perforated pipe may protect the sensor from being broken due to impacts from large rocks and tree material moving in fast high-water flows.
b. The mechanical attachment between the housing and the river/stream bank may be strong enough to withstand strong sediment and water movement.
c. A system of inflation (by air or neutrally buoyant liquid) of either the conduit or part of the sensor housing may be used to promote nearly neutral buoyancy, to allow the housing to rise above sediment during large flow events.
d. The one way valve or "flap" may be used to create different pressure regions which allow the sensor measurement volume to purge sediment as flow increases.
a. The flap may allow for internal spaces to be thoroughly washed and sanitized without having to disassemble housing.
b. The housing may accommodate a variety of sensors.
c. The housing may be submerged in sub-zero temperatures, or washed in a biocide, after use to prevent marine bio-contaminants from being transported to new water locations.
d. The shape of the housing may create a low-pressure zone downstream of the flap opening resulting in a continuous flow of water from the high pressure screened side openings, over the sensor, and exiting through the downstream flap.
e. The housing may have a loop or ring which allows one to use a stake or metal pin/pipe driven into the ground to secure it.
f. The rigid metal screen may have a rugged plastic enclosure around it to further protect it from damage and create a more aerodynamic flow path, and orient the housing optimally within the current of flowing water.

g. Where allowed by environmental protection agencies, the housing may have a zinc or copper attachment to prevent biofouling.

Sensor 10 may have the following features:

a. The installation may be easier and faster to install as the location of a suitable support, such as a tree or boulder, is more flexible. For example, in a rigid installation, a tree or boulder immediately adjacent to a suitable section of a waterway may be required. In contrast, the length and flexibility of elongate support 50 allows more options, including anchor locations that are spaced from preferred areas of the waterway sensor 10. In addition, anchoring options are more flexible and sensor 10 may be installed without using rock-bolts or other robust mounting hardware, provided that elongate support 50 has sufficient support.

b. The installation may allow the sensor to be submerged in water at the thalweg, or deepest portion of the channel c. The wire may be protected by the conduit 50 between sensor element 40 and datalogger 44.

d. The installation may be less visible, reducing the likelihood of vandalism or theft e. A reduced amount and weight of installation equipment and tools simplifies installation at remote sites, which may be accessible only by hiking and/or helicopter In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be one and only one of the elements.

The scope of the following claims should not be limited by the preferred embodiments set forth in the examples above and in the drawings, but should be given the broadest interpretation consistent with the description as a whole.

What is claimed is:

1. A waterway sensor, comprising:

a housing having a sidewall that comprises a plurality of openings;

at least one sensor element disposed within the housing, the at least one sensor element sensing one or more properties of a waterway; and an elongate support connected between the housing and a bank of the waterway, the elongate support comprising a conduit that is flexible and buoyant;

wherein the elongate support is resilient and adapted to bias the housing toward a desired position within the waterway.

2. The waterway sensor of claim 1, wherein the housing comprises a one-way valve at a downstream end of the housing.

3. The waterway sensor of claim 1, wherein the elongate support comprises an air-filled conduit.

4. The waterway sensor of claim 1, wherein the housing comprises buoyant material.

5. The waterway sensor of claim 1, wherein the sidewall comprises a wedge wire screen.

6. The waterway sensor of claim 1, further comprising an expandable bladder or a ballast tank.

7. The waterway sensor of claim 6, further comprising at least one depth sensor, the depth sensor being used by a controller to control a buoyancy of the waterway sensor by adjusting a volume of the expandable bladder or an amount of ballast in the ballast tank.

8. The waterway sensor of claim 1, wherein the at least one sensor element senses a mineral concentration in water flowing in the waterway.

9. The waterway sensor of claim 8, wherein the at least one sensor element senses a concentration of salt in the water.

10. A method of sensing properties of a waterway comprising the steps of:

connecting a waterway sensor to a bank of the waterway, the waterway sensor comprising:

a housing having a sidewall that comprises a plurality of openings;

at least one sensor element disposed within the housing; and an elongate support connected between the housing and an anchor that is anchored to a bank of the waterway above a water level of the waterway, the elongate support being flexible;

positioning the housing at a desired location within the waterway, wherein at least one of the housing and the elongate support are designed to bias the housing toward the desired location; and using the at least one sensor element, sensing at least one property of the waterway.

11. The method of claim 10, wherein the housing comprises a one-way valve at a downstream end of the housing.

12. The method of claim 10, wherein the elongate support comprises an air-filled conduit.

13. The method of claim 10, wherein the elongate support is a resilient support.

14. The method of claim 10, wherein the elongate support, the housing, or both the elongate support and the housing comprise buoyant material.

15. The method of claim 10, wherein the sidewall comprises a wedge wire screen.

16. The method of claim 10, wherein the waterway sensor further comprises an expandable bladder or a ballast tank.

17. The method of claim 16, wherein the waterway sensor further comprises a depth sensor.

18. The method of claim 17, further comprising the steps of:

sensing a depth of the housing using the depth sensor; and adjusting a volume of the expandable bladder or an amount of ballast in the ballast tank to control a buoyancy of the waterway sensor.

19. The method of claim 10, wherein the step of sensing at least one property of the waterway comprises sensing a mineral concentration in the water.

20. The method of claim 19, wherein the mineral concentration is a concentration of salt.

21. The method of claim 10, further comprising the steps of:

connecting one or more additional waterway sensors to the bank of the waterway;

positioning the housing at a desired location within the waterway; and using the at least one sensor element of the one or more additional waterway sensors, sensing at least one property of the waterway.

22. The method of claim 21, wherein the desired location of the waterway sensor and the one or more additional waterway sensors are in a plane that is perpendicular to a flow direction of the waterway.

23. A waterway sensor installed on a waterway, comprising:

a housing having a sidewall that comprises a plurality of openings;

at least one sensor element disposed within the housing, the at least one sensor element sensing one or more properties of the waterway; and an elongate support connected between the housing and an anchor, the elongate support being flexible, wherein:

the housing is positioned in the waterway;

the anchor is anchored to a bank of the waterway above a water level of the waterway; and at least one of the housing and the elongate support is designed to bias the housing toward a desired position within the waterway.

* * * * *